US009951769B2

(12) United States Patent
Fukami

(10) Patent No.: US 9,951,769 B2
(45) Date of Patent: Apr. 24, 2018

(54) DIAPHRAGM PUMP INTEGRALLY INCLUDING QUICK DISCHARGE VALVE UNIT

(71) Applicant: OKENSEIKO CO., LTD., Tokyo (JP)

(72) Inventor: Tadashi Fukami, Tokyo (JP)

(73) Assignee: OKENSEIKO CO., LTD., Tokyo (JP)

( * ) Notice: Subject to any disclaimer, the term of this patent is extended or adjusted under 35 U.S.C. 154(b) by 309 days.

(21) Appl. No.: 14/826,094

(22) Filed: Aug. 13, 2015

(65) Prior Publication Data

US 2016/0047375 A1 Feb. 18, 2016

(30) Foreign Application Priority Data

Aug. 15, 2014 (JP) ..... 2014-165396

(51) Int. Cl.
*F04B 53/10* (2006.01)
*F04B 45/04* (2006.01)

(52) U.S. Cl.
CPC ..... *F04B 53/1072* (2013.01); *F04B 45/04* (2013.01); *F04B 45/043* (2013.01); *F04B 45/045* (2013.01)

(58) Field of Classification Search
CPC .... F04B 53/1072; F04B 45/04; F04B 45/043; F04B 45/045; F04B 45/047; F04B 43/02; F04B 43/04; F04B 43/025; F04B 43/026; F04B 43/0045; F04B 43/0081; F04B 49/22; F04B 49/03; F04B 39/10; F04B 39/08; F04B 39/0055; F04B 39/0061; F04B 39/123; F04B 39/12; F04B 39/121; F04B 39/125; F04B 41/02; F04B 23/02; F04B 11/0008; F04B 53/16; F04B 53/007;

(Continued)

(56) References Cited

U.S. PATENT DOCUMENTS

2005/0047940 A1* 3/2005 Nawa ..... A61B 5/02141 417/413.1
2005/0163634 A1* 7/2005 Hori ..... F04B 45/043 417/413.1

FOREIGN PATENT DOCUMENTS

JP 2012-172577 A 9/2012
JP 2012172577 A * 9/2012

OTHER PUBLICATIONS

Extended European Search Report, dated Jan. 16, 2016, European Application No. 15002355.

* cited by examiner

*Primary Examiner* — Devon Kramer
*Assistant Examiner* — Christopher Brunjes
(74) *Attorney, Agent, or Firm* — Womble Bond Dickinson (US) LLP

(57) ABSTRACT

A diaphragm pump includes a quick discharge valve unit that comprises a vessel including a supply passage, a check valve seat, a delivery passage and a discharge passage, and an elastic member configured to partition an internal space of the vessel into an input-side space connected to the supply passage and an output-side space connected to the delivery passage and the discharge passage. The elastic member includes a check valve body to prevent an inflow of air from the output-side space to the input-side space, and a discharge port valve body configured to close the discharge passage when air is supplied to the input-side space through the supply passage. The vessel includes a connecting path having a sectional area smaller than an area of a section of the supply passage, and configured to release pressurized air in the input-side space to an outside.

3 Claims, 6 Drawing Sheets

(58) Field of Classification Search
CPC ..... F04B 53/105; F04B 53/1052;
F04B 53/1055; F04B 53/1062
See application file for complete search history.

PRIOR ART

DIAPHRAGM PUMP INTEGRALLY INCLUDING QUICK DISCHARGE VALVE UNIT

BACKGROUND OF THE INVENTION

The present invention relates to a diaphragm pump integrally including a quick discharge valve unit.

A diaphragm pump is generally used to supply pressurized air to a pressurization target such as a sphygmomanometer. The diaphragm pump is a pump which delivers air to a pressurization target by deforming a diaphragm portion made of an elastic material. A quick discharge valve unit is integrated with a delivery port of the diaphragm pump like this. When the operation of the diaphragm pump is stopped, the quick discharge valve unit discharges pressurized air remaining in a pressurization target within a short time (e.g., Japanese Patent Laid-Open No. 2012-172577 (see patent literature 1)).

FIG. 6 shows an example of the conventional diaphragm pump integrally including the quick discharge valve unit.

A diaphragm pump 100 includes a diaphragm 7 including a plurality of diaphragm portions 71, a partition member 8 formed on the diaphragm 7, and a quick discharge valve unit 2 formed on the partition member 8.

The diaphragm portions 71 of the diaphragm 7 and the partition member 8 form pump chambers 70. By deforming the plurality of diaphragm portions 71 in order, air taken into each pump chamber 70 through a suction passage 82 formed in the partition member 8 is delivered from an output passage 81 to the quick discharge valve unit 2. A suction valve body 75 and delivery valve body 84 are valve bodies for preventing backflows.

The quick discharge valve unit 2 includes a vessel 9 including a lower housing 10 having a supply passage 106 and an upper housing 11 having a discharge passage 111*a*, and an elastic member 12 which partitions the inner space of the vessel 9 into an input-side space 9*a* connected to the pump chamber 70 through the supply passage 106 and an output-side space 9*b* connected to a delivery passage 113*a* and the discharge passage 111*a*. The elastic member 12 includes a discharge port valve body 121 which closes the discharge passage 111*a* when air is supplied to the input-side space 9*a* through the supply passage 106, and a check valve body 122 which forms, together with a check valve seat 107 formed in the lower housing 10, a check valve for preventing an inflow of air from the output-side space 9*b* to the input-side space 9*a*.

While the diaphragm pump 100 is in operation, air delivered from the output passage 81 formed in the partition member 8 is supplied to the input-side space 9*a* through the supply passage 106 formed in the lower housing 10, flows to the output-side space 9*b* through the check valve (107, 122) and a groove connecting hole 108*b* formed in a projection 108 of the lower housing 10, and is delivered from the delivery passage 113*a* formed in a projecting cylinder 113 to a pressurization target (not shown).

When the flow rate of air to be supplied to the input-side space 9*a* is equal to or lower than a given value, the check valve including the check valve body 122 and check valve seat 107 is kept closed, and the air flows to the output-side space 9*b* through only the connecting hole 108*b* and is delivered from the delivery passage 113*a* to the pressurization target (not shown).

On the other hand, when the flow rate of air to be supplied from the pump chamber 70 to the input-side space 9*a* increases, the air flows to the output-side space 9*b* through not only the connecting hole 108*b* but also the check valve including the check valve body 122 and check valve seat 107.

If, however, air to be supplied to the input-side space 9*a* has a flow rate to such an extent that the air starts flowing to the output-side space 9*b* through the check valve including the check valve body 122 and check valve seat 107, air which flows from the input-side space 9*a* to the output-side space 9*b* at the timing at which the check valve including the check valve body 122 and check valve seat 107 opens is added to the air passing through the connecting hole 108*b*. This increases or decreases the flow rate of air to be delivered from the delivery passage 113*a* to a pressurization target. If the flow rate of air to be delivered to the pressurization target decreases, therefore, pressurization to the pressurization target becomes unstable.

SUMMARY OF THE INVENTION

It is an object of the present invention to provide a diaphragm pump integrally including a quick discharge valve unit and still capable of stably pressurizing a pressurization target.

To achieve this object, a diaphragm pump integrally including a quick discharge valve unit according to the present invention comprises a diaphragm including an elastically deformable diaphragm portion, a partition member placed on the diaphragm and forming a pump chamber together with the diaphragm portion, the partition member including a suction passage through which air to be taken into the pump chamber from an outside flows and an output passage through which air output from the pump chamber flows, a driving mechanism configured to deform the diaphragm portion to expand and contract the pump chamber, and a quick discharge valve unit formed on the partition member, and configured to deliver air output from the output passage to an external pressurization target, and discharge pressurized air remaining in the pressurization target, the quick discharge valve unit comprising a vessel including a first housing including a supply passage and a check valve seat through which air output from the output passage flows, and a second housing including a delivery passage through which air to be supplied to the pressurization target flows and a discharge passage which is open to an outside, and an elastic member partitioning an internal space of the vessel into an input-side space to which air output from the output passage is input through the supply passage, and an output-side space connected to the delivery passage and the discharge passage, the elastic member comprising a check valve body configured to form, together with the check valve seat, a check valve which prevents an inflow of air from the output-side space to the input-side space, and a discharge port valve body configured to close the discharge passage when air is supplied to the input-side space through the supply passage, wherein the first housing includes a connecting path configured to release pressurized air in the input-side space to an outside, the connecting path having a sectional area smaller than an area of a section of the supply passage, which is perpendicular to a longitudinal direction.

DESCRIPTION OF THE PREFERRED EMBODIMENTS

An embodiment of the present invention will be explained below with reference to FIGS. 1 to 5.

<Arrangement of Diaphragm Pump Integrated with Quick Discharge Valve>

Figure 1:
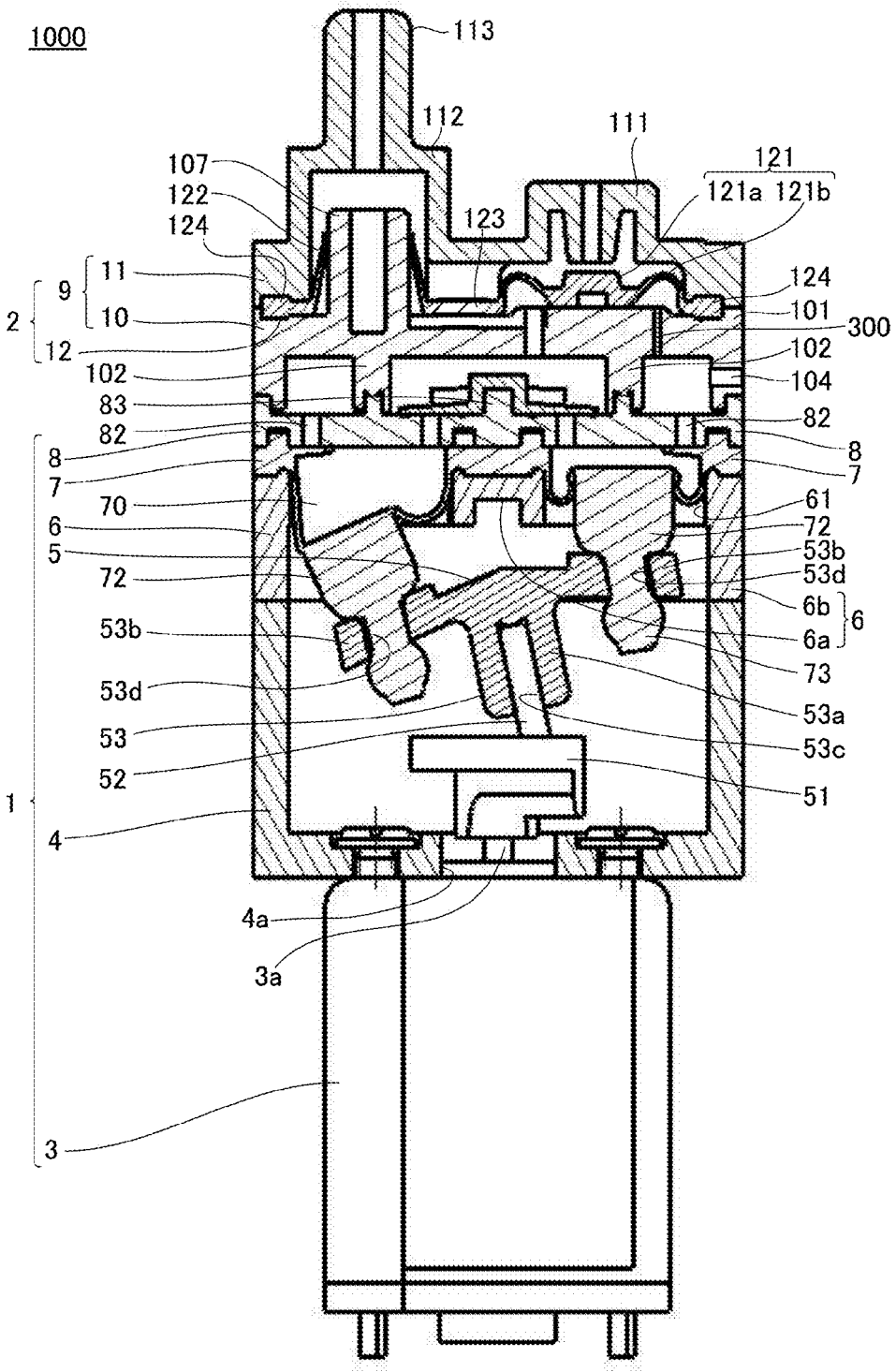
FIG. 1 is a view showing the arrangement of a diaphragm pump integrally including a quick discharge valve unit according to an embodiment of the present invention.

As shown in FIG. 1, a diaphragm pump 1000 according to this embodiment includes a diaphragm pump main body 1 and quick discharge valve unit 2.

<Arrangement of Diaphragm Pump Main Body>

The diaphragm pump main body 1 includes a motor 3, a case 4 to which the motor 3 is fixed, a driving mechanism 5 accommodated in the case 4, a diaphragm holder 6 formed on the case 4, a diaphragm 7 held by the diaphragm holder 6, and a partition member 8 formed on the diaphragm 7.

The case 4 is a bottomed cylindrical member having one open end and one closed end. In this embodiment, the bottom portion of the case 4 has an almost square shape in a planar view. The case 4 is made of, e.g., a resin. The motor 3 is fixed to the bottom portion of the case 4 from outside the case 4. An output shaft 3*a* of the motor 3 is inserted into the case 4 from a hole 4*a* formed in the bottom portion of the case 4, and connected to the driving mechanism 5.

The driving mechanism 5 includes a crank table 51 fixed to the output shaft 3*a* of the motor 3, a driving shaft 52 having one end portion fixed to the crank table 51, and a driving member 53 fitted on the driving shaft 52. The crank table 51 is an almost columnar member made of, e.g., a resin. One end portion of the driving shaft 52 is fixed to a portion of the crank table 51, which is eccentric from the output shaft 3*a* of the motor 3. The driving shaft 52 is attached to the crank table 51 so as to be inclined to the axis of the output shaft 3*a* of the motor 3. The driving member 53 is supported by the driving shaft 52 so as to be rotatable around it.

The driving member 53 is a member made of, e.g., a resin. The driving member 53 includes a columnar base portion 53*a* having one end portion in which a non-through hole 53*c* is formed, and a driving element 53*b* which extends from the other end portion of the base portion 53*a* in a direction perpendicular to the axis of the base portion 53*a*. The driving member 53*b* has a locking hole 53*d* which engages with a projection 73 of a piston 72 formed in the diaphragm 7 (to be described later).

The diaphragm holder 6 is a member including a cylindrical portion 6*b* attached to the open end portion of the case 4, and a top plate 6*a*. The diaphragm holder 6 is made of, e.g., a resin. The top plate 6*a* of the diaphragm holder 6 has a holding hole 61 which holds a diaphragm portion 71 of the diaphragm 7 (to be described later). In this embodiment, two holding holes 61 are formed around a central portion of the top plate 6*a* of the diaphragm holder 6 at positions at an angle of 180° in the circumferential direction in a planar view.

The diaphragm 7 includes two semispherical diaphragm portions 71, and a flange 7*a* which connects the edges of the openings of the two diaphragm portions 71. The two diaphragm portions 71 are formed around a central portion of the flange 7*a* at positions at an angle of 180° in the circumferential direction in a planar view. The diaphragm 7 is made of an elastic material such as rubber. In this embodiment, the diaphragm portions 71 and the flange 7*a* having an almost square shape in a planar view are integrated.

The piston 72 is formed at the top of each diaphragm portion 71. The projection 73 for locking is integrated with one end of each piston 72. Also, a suction valve body 75 extending parallel to the flange 7*a* from the open end portion of each diaphragm portion 71 is formed in a portion of the open end portion. In this embodiment, the suction valve body 75 is integrated with the diaphragm 7.

The diaphragm 7 as described above is attached to the diaphragm holder 6 by inserting the diaphragm portions 71 into the holding holes 61 of the diaphragm holder 6. The projections 73 of the diaphragm portions 71 are pressed into the locking holes 53*d* of the driving member 53. The diaphragm holder 6 holding the diaphragm 7 is placed on the upper open end of the case 4.

The partition member 8 is a plate-like member made of, e.g., a resin, and having a square shape in a planar view. The partition member 8 is placed on the upper end portion of the diaphragm holder 6, clamps the diaphragm 7 together with the diaphragm holder 6, and forms a pump chamber 70 together with each diaphragm portion 71 of the diaphragm 7.

Also, an output passage 81 and suction passage 82 connected to each pump chamber 70 are formed in the partition member 8. In this embodiment, the output passage 81 is formed in an almost central portion of the partition member 8, and connects each pump chamber 70 and a supply space 105 (to be described later). The suction passage 82 is formed near the edge of the partition member 8, and connects each pump chamber 70 and a suction space 103 (to be described later). The suction valve body 75 of the diaphragm 7 is positioned in the opening of the suction passage 82, which is formed in the pump chamber 70. The suction valve body 75 functions as a check valve which regulates a backflow of air from the pump chamber 70 to the suction passage 82.

In addition, a projection 83 is formed in a central portion of a surface of the partition member 8, which is opposite to a surface facing the diaphragm 7. A delivery valve body 84 is attached to the projection 83. The delivery valve body 84 attached to the projection 83 regulates a backflow of air from the output passage 81 to the pump chamber 70 by closing the upper end of the output passage 81.

<Arrangement of Quick Discharge Valve Unit>

The quick discharge valve unit 2 includes a vessel 9 including a lower housing 10 and upper housing 11, and a quick discharge valve 12. The quick discharge valve 12 partitions the inner space of the vessel 9 into two spaces, i.e., an input-side space 9*a* of the lower housing 10 and an output-side space 9*b* of the upper housing 11.

The lower housing 10 is a plate-like member made of, e.g., a resin and having an almost square shape in a planar view. A cylindrical sidewall 101 is formed on the outer edges of the lower surface of the lower housing 10. A cylindrical partition 102 is formed in a central portion of the lower surface of the lower housing 10.

The lower housing 10 as described above is placed on the partition member 8, and the suction space 103 is formed by the lower surface, sidewall 101, and partition 102 of the lower housing 10 and the upper surface of the partition member 8. The suction space 103 is connected to the outside by an inflow passage 104 formed in the sidewall 101. The suction space 103 is also connected to the pump chamber 70 by the suction passage 82 formed in the partition member 8.

Also, the supply space 105 is formed by the lower surface and partition 102 of the lower housing 10 and the partition member 8. The supply space 105 is connected to the input-side space 9*a* of the vessel 9 through a supply passage 106 formed in an almost central portion of the lower housing 10.

A cylindrical check valve seat 107 is formed in a position, on the upper surface of the lower housing 10, spaced apart from the opening of the supply passage 106. A connecting path 300 for connecting the suction space 103 and the input-side space 9*a* of the vessel 9 is formed in the lower housing 10. The inner diameter of the connecting path 300 is defined to be half or less the inner diameter of the supply passage 106. The lower housing 10 is equivalent to a first housing of the present invention.

The upper housing 11 is a bottomed cylindrical member made of, e.g., a resin, and having a square shape with an open lower surface in a planar view. A discharge cylinder 111 and projection 112 are formed on the upper surface of the upper housing 11. A discharge passage 111*a* open to the outside is formed in the discharge cylinder 111. The lower end face of the discharge cylinder 111 forms a discharge port valve seat 111*b*. Also, a circular projecting cylinder 113 having a delivery passage 113*a* is formed on the upper end portion of the projection 112. The delivery passage 113*a* formed in the projecting cylinder 113 delivers air to be supplied to a pressurization target. The upper housing 11 including the delivery passage 113*a* through which air to be supplied to a pressurization target passes and the discharge passage 111*a* open to the outside is equivalent to a second housing of the present invention.

The quick discharge valve 12 is an elastic member entirely made of an elastic material such as rubber, and formed into a plate having an almost square shape in a planar view. A support portion 124 formed around the edges of the quick discharge valve 12 is sandwiched between the lower housing 10 and upper housing 11, thereby partitioning the inner space of the vessel 9 into the input-side space 9*a* and output-side space 9*b*. Also, the quick discharge valve 12 includes a discharge port valve body 121 which closes the discharge passage 111*a* formed in the discharge cylinder 111 of the upper housing 11, and a check valve body 122 which forms, together with the check valve seat 107 formed in the lower housing 10, a check valve for preventing an inflow of air from the output-side space 9*b* to the input-side space 9*a*. More specifically, the quick discharge valve 12 includes the discharge port valve body 121 formed in a position facing the discharge port valve seat 111*b* of the discharge cylinder 111, the check valve body 122 formed in a position facing the check valve seat 107, a coupling portion 123 which is formed between the discharge port valve body 121 and check valve body 122 and couples them, and the support portion 124 formed around the discharge port valve body 121, check valve body 122, and coupling portion 123. The discharge port valve body 121, check valve body 122, coupling portion 123, and support portion 124 are integrated.

The discharge port valve body 121 includes a disk-shaped discharge port valve main body 121*a*, and a discharge port valve main body support portion 121*b* formed around the discharge port valve main body 121*b*. The discharge port valve main body 121*a* selectively comes in contact by pressure with the discharge port valve seat 111*b* of the upper housing 11 or the upper surface of the lower housing 10, in accordance with the relationship between the internal pressures of the input-side space 9*a* and output-side space 9*b*.

The discharge port valve main body 121*a* is formed thicker than the discharge port valve main body support portion 121*b*, and has rigidity to such an extent that no strain occurs when the discharge port valve main body 121*a* comes in contact by pressure with the discharge port valve seat 111*b* or lower housing 10. On the other hand, the discharge port valve main body support portion 121*b* has a curved longitudinal sectional shape so as to be flexible.

The check valve body 122 has a truncated conical cylindrical shape projecting upward. The inner diameter of an opening in the upper bottom of the check valve body 122 is made equal to the outer diameter of the check valve seat 107. Accordingly, when the diaphragm pump 1000 integrated with the quick discharge valve is not driven, the inside of the distal end portion of the upper bottom of the check valve body 122 abuts against the circumferential surface of the check valve seat 107. Also, the inner diameter of an opening in the lower bottom of the check valve body 122 is made larger than the outer diameter of the proximal end portion of the check valve seat 107. Therefore, the inner surface of the lower bottom of the check valve body 122 is spaced apart from the circumferential surface of the check valve seat 107. The check valve body 122 forms a check valve together with the check valve seat 107, allows an outflow of air from the input-side space 9*a* to the output-side space 9*b* of the vessel 9, and prevents an inflow of air from the output-side space 9*b* to the input-side space 9*a* of the vessel 9.

To assemble the quick discharge valve unit 2, the quick discharge valve 12 is first placed on the upper surface of the lower housing 10 in a state in which the check valve seat 107 is inserted into the check valve body 122. Then, the upper housing 11 is placed on the lower housing 10 such that the discharge port valve seat 111*b* of the upper housing 11 faces the discharge port valve body 121*a*, and the projection 112 faces the check valve seat 107 and check valve body 122.

As a consequence, the support portion 124 of the quick discharge valve 12 is sandwiched between the upper surface of the lower housing 10 and the lower surface of the upper housing 11 and supported inside the vessel 9. Accordingly, the quick discharge valve 12 partitions the inner space of the vessel 9 into the input-side space 9*a* connected to the supply passage 106 and the output-side space 9*b* connected to the discharge passage 111*a* and delivery passage 113*a*.

The motor 3, case 4, diaphragm holder 6, diaphragm 7, partition member 8, and quick discharge valve unit 2 described above are stacked in this order and integrated. An adhesive can be used to fix adjacent members, but it is also possible to use, e.g., a spring which fixes the quick discharge valve unit 2 to the case 4 so as to push the quick discharge valve unit 2 against the motor 3.

<Operation of Diaphragm Pump Integrally Including Quick Discharge Valve Unit>

When the motor 3 is rotated in the diaphragm pump 1000 integrally including the quick discharge valve unit constructed as described above, the driving shaft 52 fixed to the crank table 51 rotates in a state in which the driving shaft 52 is inclined to the output shaft 3*a* of the motor 3, and the driving element 53*b* of the driving member 53 supported by the driving shaft 52 and the pistons 72 locked by the driving element 53*b* reciprocate along a direction parallel to the output shaft 3*a* of the motor 3, i.e., in the vertical direction of the drawings. Thus, the driving mechanism 5 converts the rotational motion of the motor 3 into the vertical reciprocal motion of the pistons 72.

The vertical reciprocal motion of the pistons 72 deforms the two diaphragm portions 71, and the two pump chambers 70 alternately expand and contract. When the pump chamber 70 expands, air is sucked into the pump chamber 70 in a negative-pressure state from the inflow passage 104 of the lower housing 10 through the suction space 103 and suction passage 82.

Figure 2:
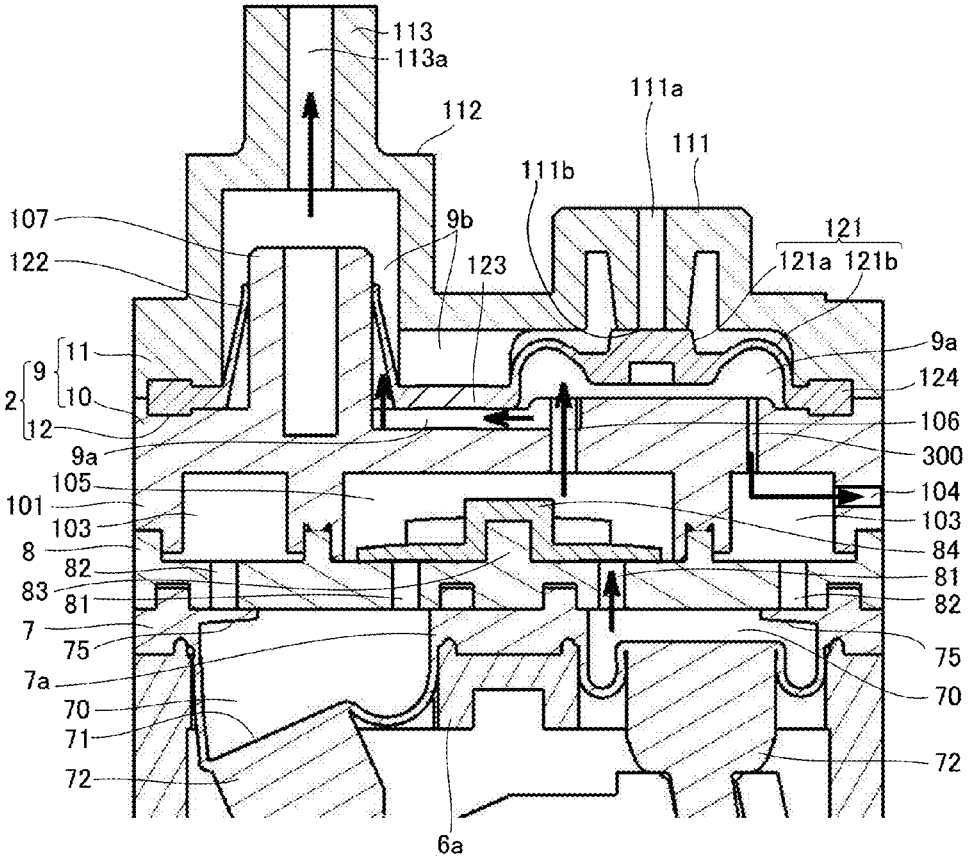
FIG. 2 is a view for explaining an operation when the diaphragm pump according to the embodiment supplies air to a pressurization target.

On the other hand, when the pump chamber 70 contracts, the internal air pressure of the pump chamber 70 rises, and, as shown in FIG. 2, air in the pump chamber 70 is output from the output passage 81 to the input-side space 9*a* of the vessel 9 through the delivery valve body 84 and supply passage 106.

When the speed of the motor 3 is low, air supplied to the input-side space 9*a* is released outside from the connecting path 300 of the lower housing 10 through the suction space 103 and inflow passage 104. As the speed of the motor 3 is increased, however, the rate at which the pump chamber 70 repeats expansion and contraction increases, and the flow rate of air to be supplied from the diaphragm pump main body 1 to the input-side space 9*a* of the vessel 9 of the quick discharge valve unit 2 increases.

Since the inner diameter of the connecting path 300 is smaller than that of the supply passage 106, therefore, the flow rate of air to be supplied from the supply passage 106 to the input-side space 9*a* becomes higher than that of air to be released outside from the connecting path 300 of the lower housing 10 through the suction space 103 and inflow passage 104. As a consequence, the pressure of the input-side space 9*a* becomes higher than that of the output-side space 9*b*, so the discharge port valve main body 121*a* of the discharge port valve body 121 is pushed against the discharge port valve seat 111*b* of the upper housing 11. Accordingly, the discharge passage 111*a* of the discharge cylinder 111 is closed, so the discharge passage 111*a* and the delivery passage 113*a* of the projecting cylinder 113 are disconnected.

Since, however, the check valve including the check valve seat 107 and check valve body 122 is closed until the flow rate of air to be supplied from the diaphragm pump main body 1 to the input-side space 9*a* exceeds a predetermined flow rate, no air is delivered from the delivery passage 113*a* of the projecting cylinder 113 to a pressurization target.

When the speed of the motor 3 further rises and the flow rate of air to be supplied from the diaphragm pump main body 1 to the input-side space 9*a* of the vessel 9 of the quick discharge valve unit 2 exceeds a predetermined flow rate, the internal pressure of the input-side space 9*a* exceeds the elasticity of the check valve body 122, so the distal end portion of the upper bottom of the check valve body 122 is separated from the circumferential surface of the check valve seat 107 of the lower housing 10. Consequently, a part of air supplied from the diaphragm pump main body 1 to the input-side space 9*a* of the vessel 9 of the quick discharge valve unit 2 is released outside from the connecting path 300 of the lower housing 10 through the suction space 103 and inflow passage 104, and the rest flows from the input-side space 9*a* to the output-side space 9*b* through the gap formed between the check valve body 122 and check valve seat 107, and is delivered from the delivery passage 113*a* of the projecting cylinder 113 to the pressurization target.

On the other hand, when the speed of the motor 3 decreases, the flow rate of air to be supplied from the supply passage 106 to the input-side space 9*a* decreases, so the internal pressure of the input-side space 9*a* decreases. Consequently, the gap between the distal end portion of the check valve body 122 and the circumferential surface of the check valve seat 107 decreases. Therefore, the flow rate of air to be delivered from the delivery passage 113*a* of the projecting cylinder 113 to the pressurization target through this gap decreases.

Figure 5:
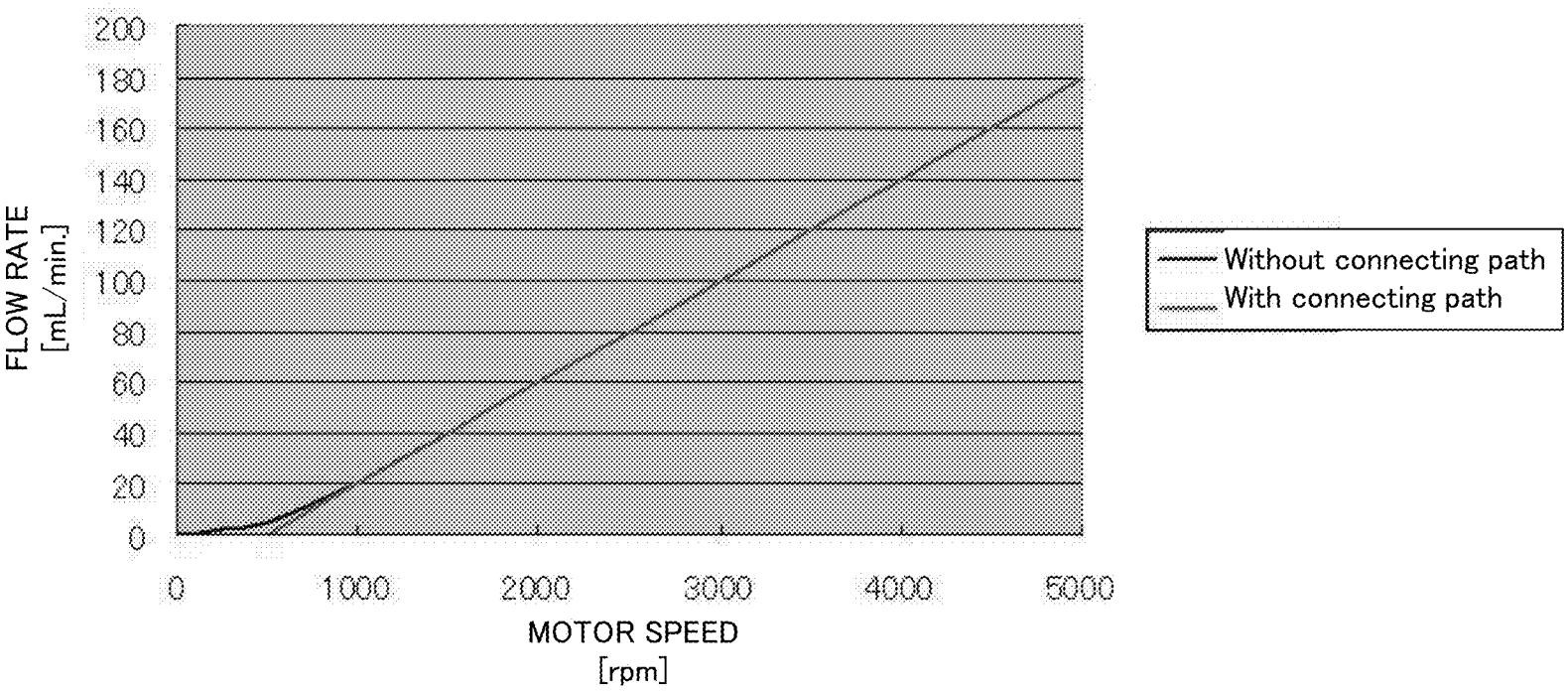
FIG. 5 is a graph showing the supply characteristic of the diaphragm pump integrally including the quick discharge valve unit.
Figure 6:
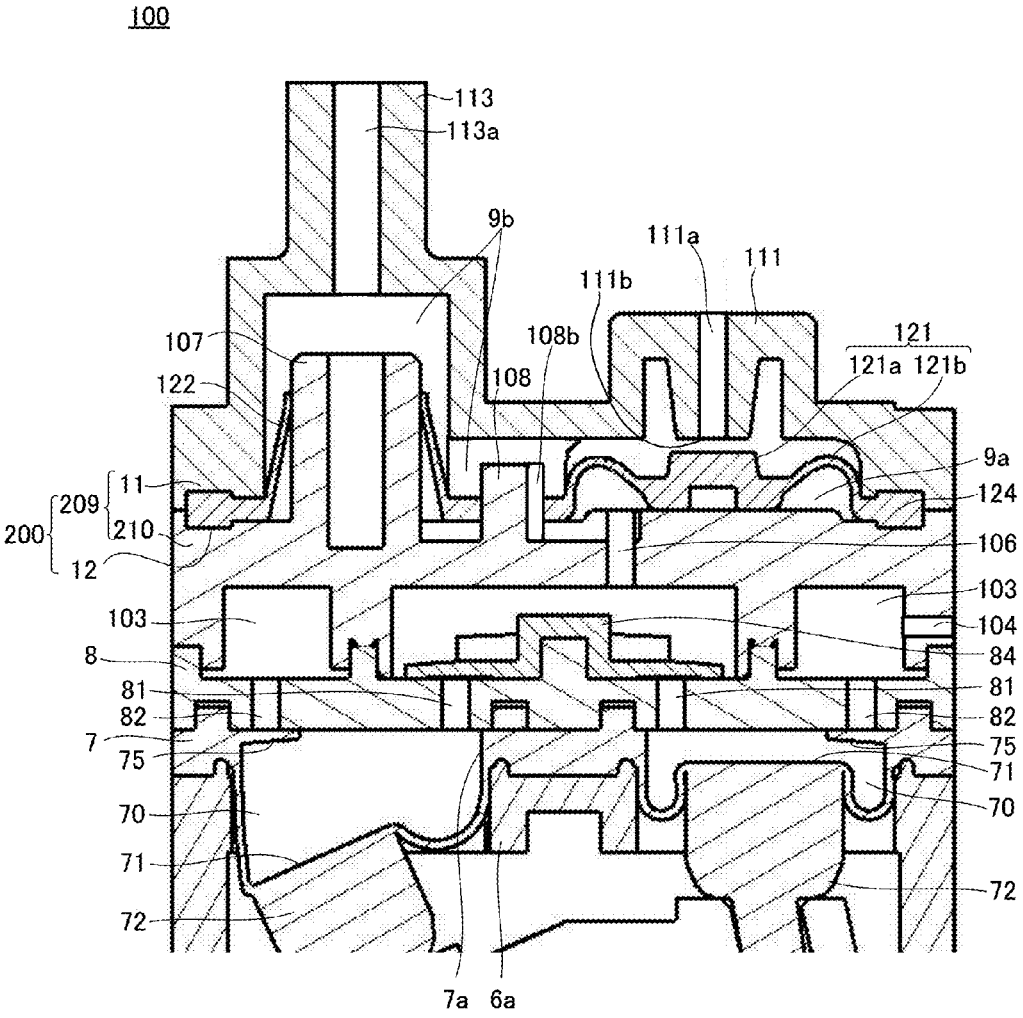
FIG. 6 is a view for explaining the arrangement of a conventional diaphragm pump integrally including a quick discharge valve unit.

FIG. 5 shows examples of the supply characteristic of the diaphragm pump integrally including the quick discharge valve unit.

As shown in FIG. 5, the supply characteristic of a conventional diaphragm pump including a quick discharge valve unit and the supply characteristic of the diaphragm pump including the quick discharge valve unit in which the connecting path 300 is formed in the lower housing 10 are almost the same when the speed of the motor 3 is 1,000 rpm or more. When the speed of the motor 3 is 1,000 rpm or less in the conventional diaphragm pump, however, the flow rate of air to be supplied to the input-side space 9*a* of the vessel 9 of the quick discharge valve 2 is low, so the flow rate of air to be supplied to a pressurization target is nonlinear.

By contrast, when the speed of the motor 3 is 500 rpm or less in the diaphragm pump according to this embodiment, most of air supplied to the input-side space 9*a* is released outside from the connecting path 300 of the lower housing 10 through the suction space 103 and inflow passage 104. Accordingly, almost no air is delivered from the delivery passage 113*a* of the projecting cylinder 113 to a pressurization target.

When the speed of the motor 3 exceeds 500 rpm, however, the flow rate of air to be supplied from the supply passage 106 to the input-side space 9*a* becomes higher than that of air to be released outside from the connecting path 300 through the suction space 103 and inflow passage 104. Therefore, the pressure of the input-side space 9*a* of the vessel 9 of the quick discharge valve unit 2 becomes higher than that of the output-side space 9*b*, so the discharge port valve main body 121*a* of the discharge port valve body 121 is pushed against the discharge port valve seat 111*b* of the upper housing 11, thereby closing the discharge passage 111*a* of the discharge cylinder 111.

When the speed of the motor 3 further rises, the distal end portion of the upper bottom of the check valve body 122 is separated from the circumferential surface of the check valve seat 107 of the lower housing 10, so air supplied to the quick discharge valve unit 2 flows to the output-side space 9*b* from the gap formed between the check valve body 122 and check valve seat 107, and is delivered from the delivery passage 113*a* of the projecting cylinder 113 to the pressurization target. In this state, the flow rate of air flowing through the gap formed between the check valve body 122 and check valve seat 107 changes almost linearly with respect to the speed of the motor 3, i.e., the flow rate of air to be supplied from the diaphragm pump main body 1 to the quick discharge valve unit 2. As a consequence, the pressurization target is stably pressurized.

Figure 3:
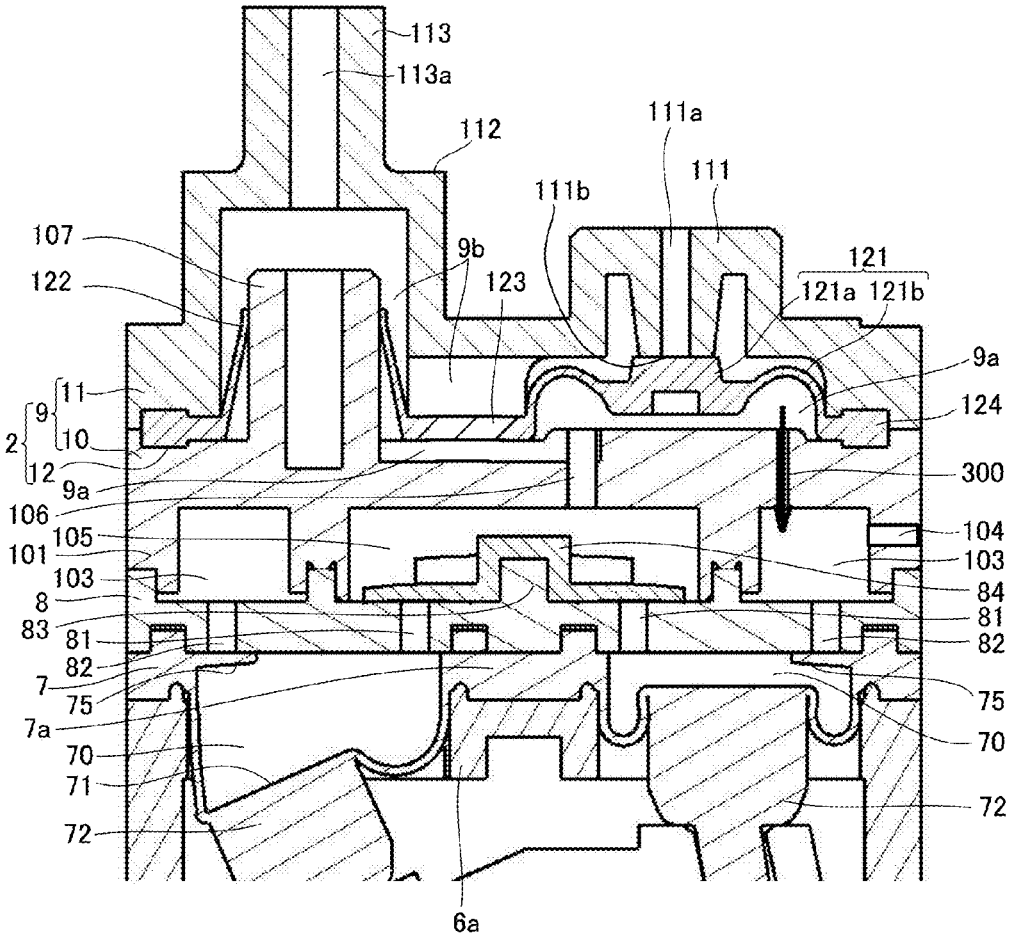
FIG. 3 is a view for explaining the flow of air immediately after the diaphragm pump according to the embodiment stops supplying air to the pressurization target.

When the supply of air to the input-side space 9*a* of the vessel 9 is stopped by stopping the motor 3 after that, as shown in FIG. 3, air in the input-side space 9*a* is released outside from the connecting path 300 through the suction space 103 and inflow passage 104, while the internal pressure of the input-side space 9*a* is higher than the atmospheric pressure.

Figure 4:
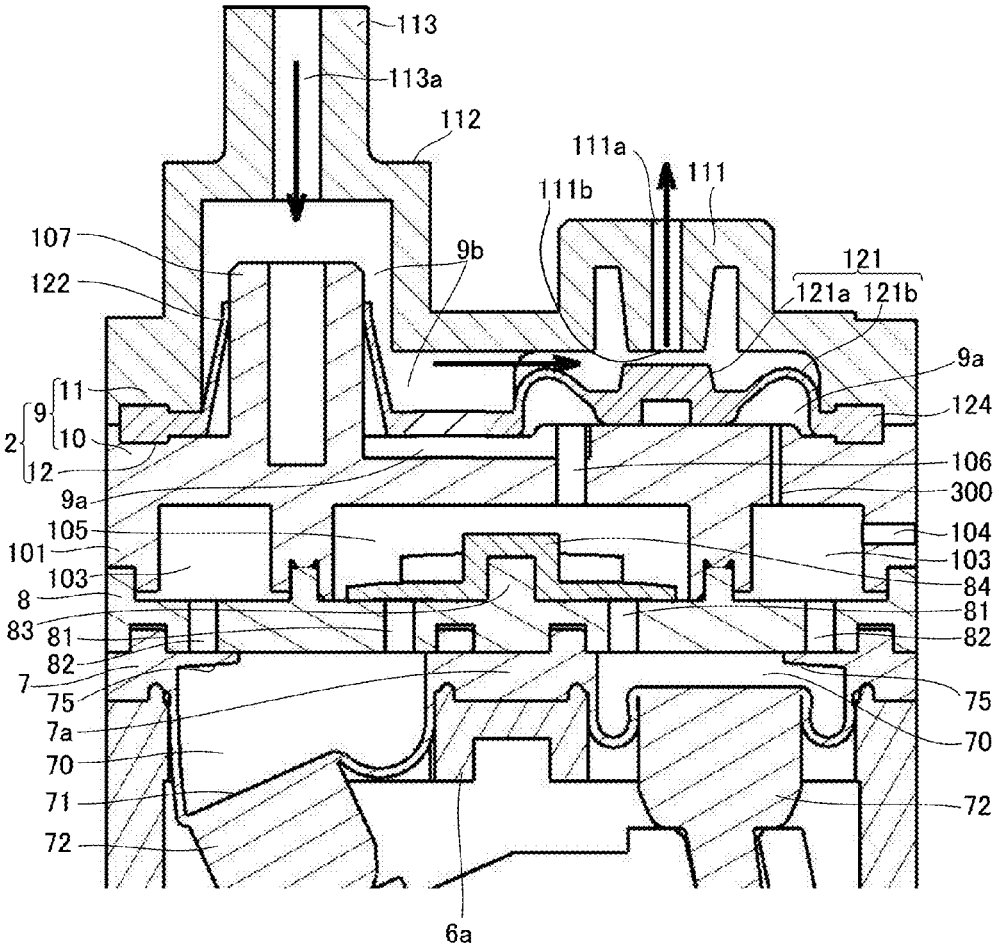
FIG. 4 is a view for explaining the flow of air discharged from the quick discharge valve unit in the diaphragm pump according to the embodiment.

At the same time, air supplied to the pressurization target flows backward from the delivery passage 113*a* of the projecting cylinder 113 to the output-side space 9*b* of the vessel 9, and the pressure of the output-side space 9*b* of the vessel 9 becomes higher than that of the input-side space 9*a*. As a result, the discharge port valve main body 121*a* of the discharge port valve body 121 is pushed downward. As shown in FIG. 4, therefore, the output-side space 9*b* is connected to the outside by the discharge passage 111*a*, and air having flowed backward from the pressurization target to the output-side space 9*b* of the vessel 9 is discharged outside within a short time through the discharge passage 111*a*.

<Other Embodiments>

Note that in the above-described embodiment, an example in which the connecting hole 300 for connecting the input-side space 9*a* and suction space 103 is formed in the lower housing 10 has been described. However, the present invention is not limited to this. For example, it is also possible to form a connecting path having one end which opens in the input-side space 9*a* and the other end which opens to the outside, instead of the connecting hole 300, thereby directly connecting the input-side space 9*a* and the outside of the quick discharge valve unit without using the suction space 103.

Also, the above-described embodiment has been explained by taking the case in which the diaphragm pump main body 1 includes the two pump chambers 70 as an example. However, the present invention is not limited to this, and is also applicable to a diaphragm pump main body including one pump chamber or three or more pump chambers.

In the present invention, when the flow rate of air to be supplied from the pump chamber 70 to the input-side space 9*a* is equal to or lower than a predetermined flow rate, the air supplied to the input-side space 9*a* is released outside through the connecting path 300, and no air is delivered from the delivery passage 113*a* to a pressurization target. On the other hand, when the flow rate of air to be supplied from the pump chamber 70 to the input-side space 9*a* exceeds the predetermined flow rate, the air is stably delivered from the delivery passage 113*a* to the pressurization target via the check valve including the valve seat 107 and the valve body 122. Although the quick discharge valve unit is integrally included, therefore, the pressurization target can stably be pressurized while air is delivered to the pressurization target.

What is claimed is:

1. A diaphragm pump integrally comprising:

a diaphragm including an elastically deformable diaphragm portion;

a partition member placed on the diaphragm and forming a pump chamber together with the diaphragm portion, the partition member including a suction passage through which air to be taken into the pump chamber from an outside space of the diaphragm pump flows and an output passage through which air output from the pump chamber flows;

a driving mechanism configured to deform the diaphragm portion to expand and contract the pump chamber; and a quick discharge valve unit formed on the partition member, and configured to deliver air output from the output passage to an external pressurization target, and discharge pressurized air remaining in the pressurization target, the quick discharge valve unit comprising:

a vessel including a first housing including a supply passage and a check valve seat through which air output from the output passage flows, and a second housing including a delivery passage through which air to be supplied to the pressurization target flows and a discharge passage which is open to the outside space; and an elastic member partitioning an internal space of the vessel into an input-side space to which air output from the output passage is input through the supply passage, and an output-side space connected to the delivery passage and the discharge passage, the elastic member comprising:

a check valve body configured to form, together with the check valve seat, a check valve which prevents an inflow of air from the output-side space to the input-side space; and a discharge port valve body configured to close the discharge passage when air is supplied to the input-side space through the supply passage, wherein the first housing includes a connecting path configured to release pressurized air in the input-side space to the outside space, the connecting path having a sectional area smaller than an area of a section of the supply passage, the sectional area of the connecting path being perpendicular to a longitudinal direction of the connecting path, and the area of the section of the supply passage being perpendicular to a longitudinal direction of the supply passage.

2. The pump according to claim 1, wherein the partition member and the first housing form a suction space connected to the outside space through an inflow passage, the suction space connecting the suction passage to the outside space, and the connecting path connects the input-side space and the suction space, having one end which is open in the input-side space and the other end which is open in the suction space.

3. The pump according to claim 1, wherein the connecting path connects the input-side space and the outside space, having one end which is open in the input-side space and the other end which is open to the outside space.

* * * * *